US005155536A

United States Patent [19]

Johnson et al.

[11] Patent Number: 5,155,536

[45] Date of Patent: Oct. 13, 1992

[54] IMAGE FORMING APPARATUS INCLUDING TONER IMAGE FIXING DEVICE USING FUSING SHEETS

[75] Inventors: Kevin M. Johnson; Thomas C. Merle, both of Rochester, N.Y.

[73] Assignee: Eastman Kodak Company, Rochester, N.Y.

[21] Appl. No.: 783,475

[22] Filed: Oct. 28, 1991

[51] Int. Cl.[5] ..... G03G 15/20

[52] U.S. Cl. ..... 355/290; 355/285; 355/326; 430/124; 219/216

[58] Field of Search ..... 355/290, 289, 285, 326, 355/282; 430/124, 33; 118/59, 60; 219/216, 388; 432/60

[56] References Cited

U.S. PATENT DOCUMENTS

| | | | |
|---|---|---|---|
| 3,948,215 | 4/1976 | Namiki . | |
| 3,992,833 | 2/1977 | Derimiggio . | |
| 4,927,727 | 5/1990 | Rimai et al. . | |
| 4,931,618 | 6/1990 | Nagata et al. | 219/216 |
| 4,968,578 | 11/1990 | Light et al. . | |
| 5,021,835 | 6/1991 | Johnson . | |
| 5,023,038 | 6/1991 | Aslam et al. . | |
| 5,085,962 | 2/1992 | Aslam et al. | 430/99 |

FOREIGN PATENT DOCUMENTS

| | | |
|---|---|---|
| 0295901 | 12/1988 | European Pat. Off. . |
| 0301585 | 2/1989 | European Pat. Off. . |

OTHER PUBLICATIONS

English abstract of Japanese Kokai Patent 1-179181, publishing date of patent Jul. 17, 1989.

*Primary Examiner*—Richard L. Moses
*Attorney, Agent, or Firm*—Leonard W. Treash

[57] ABSTRACT

A toner image, particularly a multicolor toner image is fixed to a receiving sheet, which may or may not have a heat-softenable outer layer, by use of a fusing sheet. The fusing sheet is preferably a hard, smooth sheet, for example, a metallic sheet. The fusing sheet is fed from a fusing sheet supply into overlying contact with the toner image on the receiving sheet. The fusing sheet and receiving sheet form a sandwich which is fed between a pair of rollers which apply heat and pressure to the sandwich to fix the toner image to the receiving sheet. The receiving sheet and fusing sheet sandwich is allowed to cool and is then separated. The fusing sheet is fed back to the fusing sheet supply.

21 Claims, 4 Drawing Sheets

IMAGE FORMING APPARATUS INCLUDING TONER IMAGE FIXING DEVICE USING FUSING SHEETS

RELATED APPLICATION

This application relates to co-assigned U.S. patent application Ser. No. 783476, filed Oct. 28, 1991, in the names of Kevin M. Johnson and Thomas C. Merle, entitled IMAGE FORMING APPARATUS INCLUDING TRANSFER AND FIXING MEMBER.

TECHNICAL FIELD

This invention relates to the fixing of toner images to receiving sheets. More particularly, it relates to a type of fixing in which a toner image is sandwiched between its receiving sheet and a hard surface, in conditions of elevated temperature and pressure to fix the image and in which the image is cooled before separation from the hard surface. Although not limited thereto, it is particularly useful in fixing high-quality multicolor toner images.

BACKGROUND ART

U.S. Pat. No. 4,968,578, Light et al issued Nov. 6, 1990; U.S. Pat. No. 4,927,727, Rimai et al, issued May 22, 1990, and U.S. Pat. No. 5,021,835, Johnson, issued Jun. 4, 1991, all describe a heat-assisted toner image transfer method. Two or more single color images are transferred in registration from an image member to a receiving sheet by heating the receiving sheet to an elevated temperature. The temperature of the receiving sheet is sufficiently above the softening point of the toner that the toner sticks to the receiving sheet. Preferably, the receiving sheet is heated from inside a transfer drum to which it is secured. The transfer drum and image member form a pressure nip with the combination of heat and pressure transferring the image. This method is particularly useful in transferring extremely small, dry toner particles, for example, toner particles having a mean particle diameter of 8 microns or less.

Especially in transferring a series of single color toner images to form a multicolor toner image, the layers of toner pile up above the level of the receiving sheet even when substantial pressure is used in transfer. This results in an unacceptable relief image corresponding generally to the optical density of the image. U.S Pat. No. 5,023,038 to Aslam et al issued Jun. 11, 1991 and U.S. patent application No. 07/405,258 to Rimai et al describe a method of fixing such toner images to a receiving sheet which receiving sheet has an outer heat-softenable thermoplastic layer. The relief image is substantially reduced, the image is more permanently fixed and gloss can be increased by bringing the image into contact with a ferrotyping surface under conditions of heat and pressure which cause the image to be further embedded in the thermoplastic layer. The ferrotyping surface is smooth and hard and has good release characteristics. For example, it can be made of nickel, stainless steel or other metals, with or without surface treating with silicones or the like. As disclosed in those references, the ferrotyping surface can also be textured to provide a matte or other textured finish to the image.

In designing a continuous production image-forming apparatus, the ferrotyping surface is formed on a web. The web is usually in the form of an endless belt, but it can also be quite long and have supply and take-up rolls for continuous operation. For purposes herein, the term "web" shall include but not be limited to an endless belt.

The use of endless belts generally to fix regular toner images to paper, transparency stock, or the like, has been known for many years; see, for example, U.S. Pat. No. 3,948,215; European Applications 0301585 and 0295901.

Japanese Kokai 1-179181; laid open Jul. 17, 1989 (Appl. No. 63-2288) shows a transfer drum for holding a receiving sheet. An internally heated fusing roller contacts the image after transfer to fix the image before it leaves the transfer drum.

U.S. Pat. No. 3,992,833, Derimiggio, issued Feb. 12, 1991 shows the use of individual intermediate sheets for receiving a toner image to which the image is fused before transfer to a receiving sheet. The intermediate and receiving sheet are maintained in contact until cool before separating.

Typically, in most of the above fixing processes the toner image is left in contact with the web until the image is cooled below the glass transition temperature of the toner, at which point the receiving sheet can be separated without offset. In the processes using a thermoplastic layer for receiving the image, that layer also is cooled to below its softening point before separation. Preventing offset by cooling in contact with the web eliminates the need for offset preventing liquids which have a degrading effect on a high quality image.

A problem in using a web system, especially an endless belt system in a productive image forming apparatus is associated with the time required for the belt and image to cool while maintained in contact. If the fixing device is slowed down to below the speed of the transfer station to allow cooling, then the mismatch of speeds between the transfer station and the fixing device must be accommodated. In general, this requires either a full frame distance in the in-track direction between the transfer station or drum and the fixing device, or a loop or other mechanism for absorbing the difference in speeds.

Belt fixing devices have other non-trivial problems associated with them. For example, belt tracking must be controlled. The belts are expensive and difficult to replace. If the belt has a seam the timing of the apparatus must be controlled to prevent the seam appearing in the middle of an image. The convenient availability of different textures is accomplished generally by exchanging belts, a task which is time consuming and especially difficult if the apparatus is hot. The belt has very limited room inside it for cooling structure.

DISCLOSURE OF THE INVENTION

It is an object of this invention to provide an image forming apparatus in which a toner image is fixed by contacting a hard fusing surface under conditions of heat and pressure to fix the image and that contact is maintained until the toner image is sufficiently cool to permit separation of the hard surface and the image, but without some or all of the problems associated with the use of an endless belt to supply the hard surface.

This and other objects are accomplished by an apparatus having a supply of at least one fusing sheet, each fusing sheet having finite length and a fusing surface. The fusing sheet is fed into contact with a receiving sheet having a toner image to be fixed, with the fusing surface in contact with the toner image. The apparatus includes means for heating the toner image and for urging the sheets together to apply sufficient pressure to fix the image while in contact with the fusing surface. While the receiving sheet and fusing sheet are still in contact, they are moved away from the heating means to allow the toner image to cool. Once the image is cool, the receiving sheet and fusing sheet are separated and the fusing sheet is moved back to the fusing sheet supply.

This is comparable to a process typically carried out by hand in a laboratory. For example, a receiving sheet having a loose toner image has a fusing sheet, for example a ferrotyping plate, placed over it and fed by hand between a pair of rollers. When the sheets exit the rollers, the sandwich is set aside until cool, at which point it is separated and the fusing sheet can be reused. In automating this process it has always been assumed that an endless belt is the best approach to automation. The use of a finite fusing sheet was not considered for a continuously running apparatus.

However, by using a supply of fusing sheets in a continuous process many of the above-mentioned problems with endless belts are eliminated. Perhaps the most significant advantage is that the pressure applying means can be run at the same speed as the transfer device. This allows the fixing device to be placed close to the transfer device. The fusing sheet and receiving sheet can be allowed to cool after exiting the pressure applying means for whatever cooling time is necessary.

According to a preferred embodiment, if transfer is accomplished by heat, having the fixing device close to the transfer device reduces heat loss between the two stations.

According to a further preferred embodiment, the supply of fusing sheets can include fusing sheets having different types of surfaces. The operator can choose the texture of the final image by choosing the appropriate fusing sheet.

DISCLOSURE OF THE PREFERRED EMBODIMENTS

Figure 1:
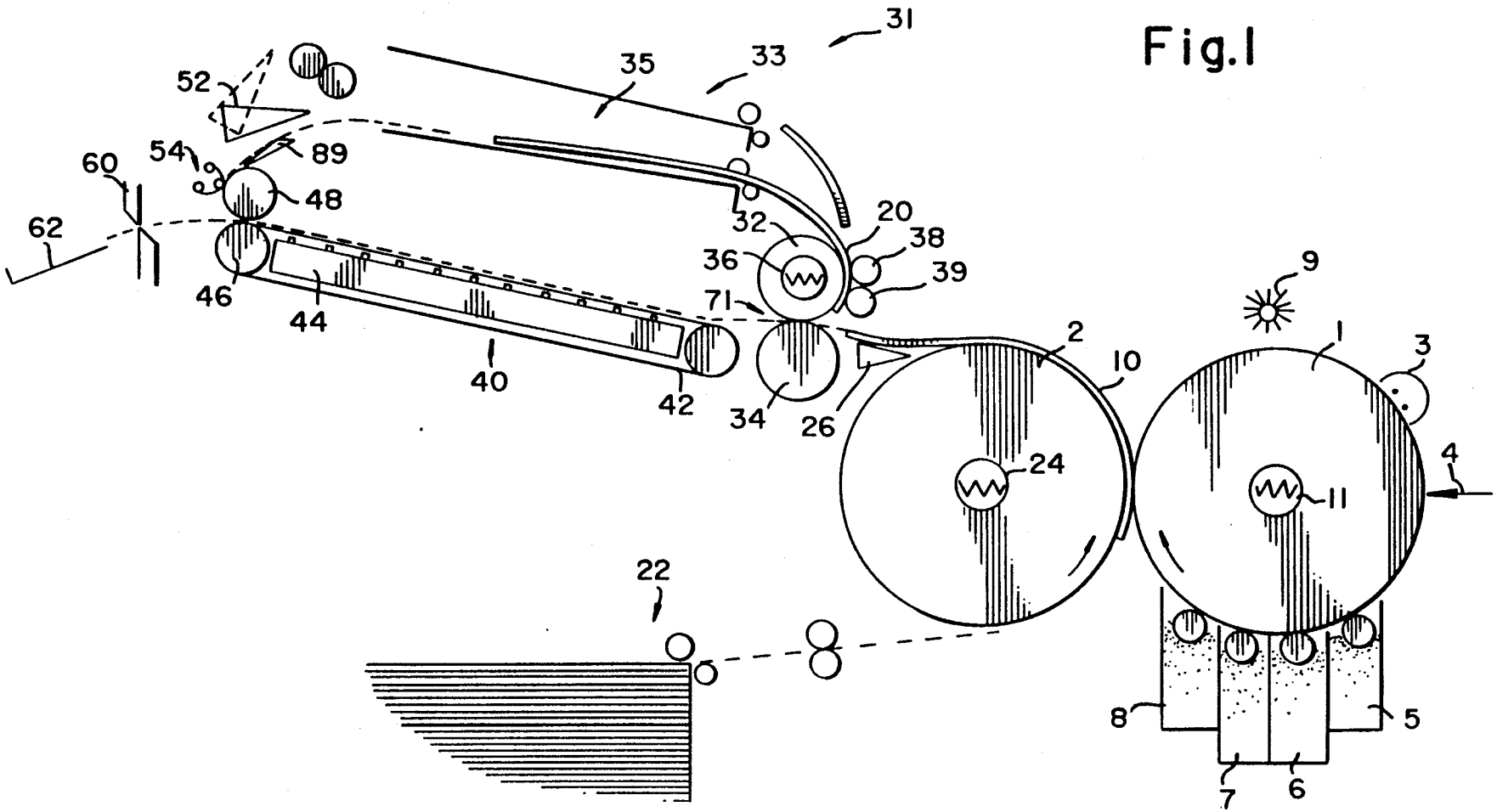
FIG. 1 is a side schematic of an image forming apparatus constructed according to the invention.

According to FIG. 1 an image forming apparatus includes an image member, for example, a photoconductive drum 1. Photoconductive drum 1 is uniformly charged by a charging station 3 and imagewise exposed at an exposure station, for example, by a laser exposing device 4 to create a series of electrostatic images. The series of electrostatic images are each toned by a different one of toner stations 5, 6, 7 and 8 to create a series of different color, single color toner images.

A receiving sheet is fed from a receiving sheet supply 22 onto the periphery of a transfer drum 2 where it is held by gripping fingers, vacuum, electrostatics or other means well known in the art. Transfer drum 2 is rotated at the same peripheral speed as image member 1 and cycles an outside surface of receiving sheet 10 through transfer relation with the series of toner images created on drum 1. The toner images are transferred to the outside surface of receiving sheet 10 in registration to create a multicolor image thereon.

For highest quality images, the transfer of the toner image is accomplished by heating the receiving sheet 10 to a temperature at which the receiving sheet raises the temperature of the toner to sinter the toner at least where it contacts other toner and attaches itself to the surface of receiving sheet 10; see U.S. Pat. Nos. 4,968,578, 4,927,727 and 5,021,835, referred to above for more details of such a heat-assisted transfer method. The heat for such transfer is provided predominantly by an internal heating lamp 24 located inside transfer drum 2. It may also be assisted by an internal heating lamp 11 located inside photoconductive drum 1, which lamp heats photoconductive drum 1 somewhat above ambient but not sufficiently above it to destroy its photoconductive properties or cause the toner to stick to photoconductive drum 1.

Although this transfer process can be used to transfer toner to plain paper or other similar stock, it is most efficient and the highest quality images are obtained if the receiving sheet 10 has a heat-softenable thermoplastic outside layer. The outside layer is softened by the heated transfer drum encouraging the toner to embed in it assisting in the transfer of at least the first layer. Subsequent layers of toner are transferred by adherence of the toner particles to each other as they are softened at least where they touch. Drum 1 is continuously cleaned by cleaning station 9, as is well known in the art.

Transfer drum 2 can be a hard metallic drum which effectively transfers the energy from lamp 24 to receiving sheet 10. A typical temperature for transfer drum 2 is 100 degrees C. The receiving sheet 10 is also raised to approximately this temperature, especially in the course of recycling to pick up three or four toner images.

After the multicolor image has been formed on transfer sheet 10, it is separated from transfer drum 2 by a movable skive 26 which also directs it into a nip 71 formed by a pair of fixing rollers 32 and 34. Preferably, roller 32 is internally heated by a lamp 36 to raise or maintain the receiving sheet 10 to a temperature at which both the toner and any thermoplastic layer are at their glass transition temperatures or above.

At the same time, a fusing sheet 20 is fed out of a fusing sheet supply 31 into contact with heated fixing roller 32. The fusing sheet 20 is maintained against fixing roller 32 by a pair of scuff rollers 38 and 39 to permit fixing roller 32 to raise fusing sheet 20 also to a temperature at or above the glass transition temperature of the toner image and any thermoplastic layer on receiving sheet 10. Alternatively, fusing sheet 20 can be held to roller 32 by a vacuum supplied through suitable openings in the roller periphery. Heated fusing sheet 20 is fed into nip 71 with its leading edge slightly preceding the leading edge of transfer sheet 10, and creates with transfer sheet 10 a sandwich which passes through nip 71 with a fusing surface of fusing sheet 20 in contact with the toner image and receiving sheet 10.

The receiving sheet and heated fusing sheet are passed through nip 71 with the fixing rollers 32 and 34 urged together to provide substantial pressure for fixation. If receiving sheet 10 has a thermoplastic layer which is softened, the pressure exerted through fusing sheet 20 further embeds the toner image in that layer. Any toner that is not so embedded is conformed to the fusing surface conformation to form the desired surface texture for the image, as will be discussed in more detail.

The fixing rollers 32 and 34 can be rotated in contact with each other until the sheets are fed between them. However, it is preferred to separate them slightly until the receiving sheet enters the nip. At this point the rollers are urged together with sufficient pressure to fix the image. Although only roller 32 is shown separately heated, with some materials, it is desirable to also heat roller 34.

The sandwich formed by the fusing sheet and receiving sheet exits nip 71 and is transported by a transport device 40 to a pair of separation rollers 46 and 48. Transport device 40 includes an endless belt 42. The sandwich adheres to the top of it by gravity or friction. It also can be held by vacuum or electrostatics. During the travel of the sandwich from nip 71 to separation rollers 46 and 48, it is cooled by a forced air cooling device 44 located inside endless belt 42. Contact cooling devices, for example, a cooling roller or plate, or other cooling devices could also be used.

Figure 3:
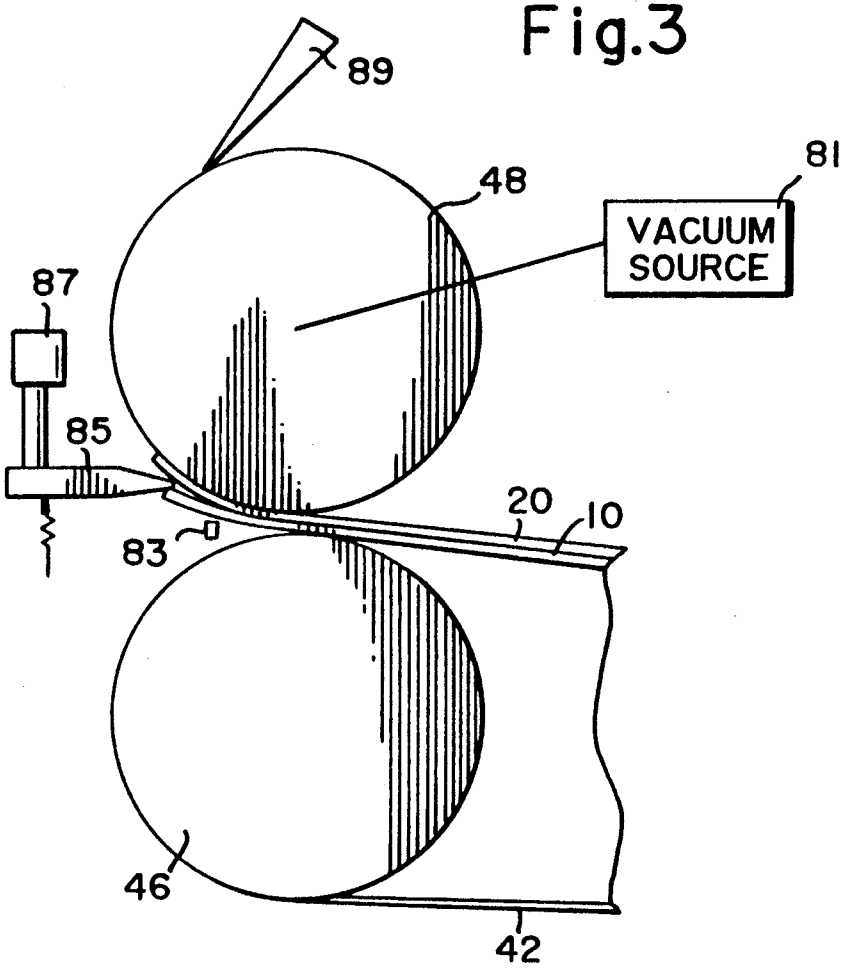

After the thermoplastic layer and toner image have cooled below their glass transition temperatures, the fusing sheet is separated from the receiving sheet at separation rollers 46 and 48 by means to be described with respect to FIGS. 3 and 4. The receiving sheet is then fed to an additional finishing device, for example, a slitter and chopper 60 and hence into an output tray 62. The fusing sheet is returned to fusing sheet supply 31 for reuse. On the way, it can be cleaned by a web cleaner 54, if necessary.

Advantages of the fixing approach illustrated in FIG. 1 are many. A primary advantage is that the fixing rollers 32 and 34 can be located close to the transfer drum 2 and can be rotated to move the receiving sheet at the same speed it is moving as it leaves drum 2. The receiving sheet thus does not lose much heat between transfer drum 2 and fixing rollers 32 and 34, and the fixing portion of the apparatus is compact and does not require substantial turns in the path of receiving sheet 10. All of these benefits are obtained because fixing rollers 32 and 34 can operate at the same speed as transfer drum 2 While the fusing sheet and receiving sheet can be allowed to cool at their leisure after leaving nip 71. For example, drums 1 and 2 can be rotated to create images on receiving sheet 10 at a rate of 4 inches per second. Fixing rollers 32 and 34 would then be rotated to move the receiving sheet 10 and fusing sheet 20 through nip 71 at 4 inches per second. However, transport device 40 can be moved at one inch per second with receiving sheet 10 sliding on its surface while driven by fixing rollers 32 and 34. The slow speed on transport device 40 permits the fusing sheet and receiving sheet to continue to cool without making the apparatus extremely long as would be necessary at 4 inches per second.

Alternatively, transport device 40 can be stopped when the sandwich of fusing sheet 20 and receiving sheet 10 is entirely free of fixing rollers 32 and 34. When a new sandwich begins through the fixing device, the transport device 40 can begin to move again. In such an embodiment the speed of transport device can be the same (or higher) as that of fixing rollers 32 and 34 and still provide the compactness advantages described. Stopping the sandwich allows use of other cooling devices not usable with a continuously moving sandwich. Note that in a four color image forming apparatus, transfer drum 2 must rotate four times for each combined multicolor image formed, so there is substantial time between images for cooling. Note also that the disadvantage of cramped space inside a belt for cooling structure is eliminated with fusing sheets.

The fact that the fixing rollers 32 and 34 are operated at the same process speed as transfer drum 2 allows them to be positioned less than a frame's distance from transfer drum 2 without interposing a loop or some other accommodation device that would be necessary if fixing rollers 32 and 34 drove the receiving sheet at a speed substantially reduced from the speed the receiving sheet is driven by transfer drum 2.

Fusing sheet 20 is chosen to provide the desired finish to the fixed toner image. Generally, it will be smooth and hard, for example, it could be formed of metals such as nickel, or stainless steel, with or without silicone or other release treatments.

A smooth, hard metallic finish will ferrotype the image under conditions of relatively high pressure between rollers 32 and 34 to provide a high gloss to the fixed image. For example, rollers 32 and 34 can be urged together at pressures of 100 pounds per square inch and above which both reduces the imagewise contour exhibited by multicolor images formed by dry electrophotographic processes and increases the gloss. Best results are achieved above 300 pounds per square inch. Alternatively, the fusing sheet can be hard and textured to provide the image with a matte or silk finish as desired. As shown in FIG. 1, fusing sheet supply 31 includes two sub-supplies 33 and 35 which can be stocked with different textured fusing sheets allowing the operator to easily choose the texture desired. Movable wedge 52 directs the fusing sheet back into its desired sub-supply 33 or 35 after separation from receiving sheet 10. To achieve high pressure it may be desirable that both rollers 32 and 34 be hard metallic rollers. At lower pressures one roller, preferably roller 34, can have a thin compliant layer.

Figure 2:
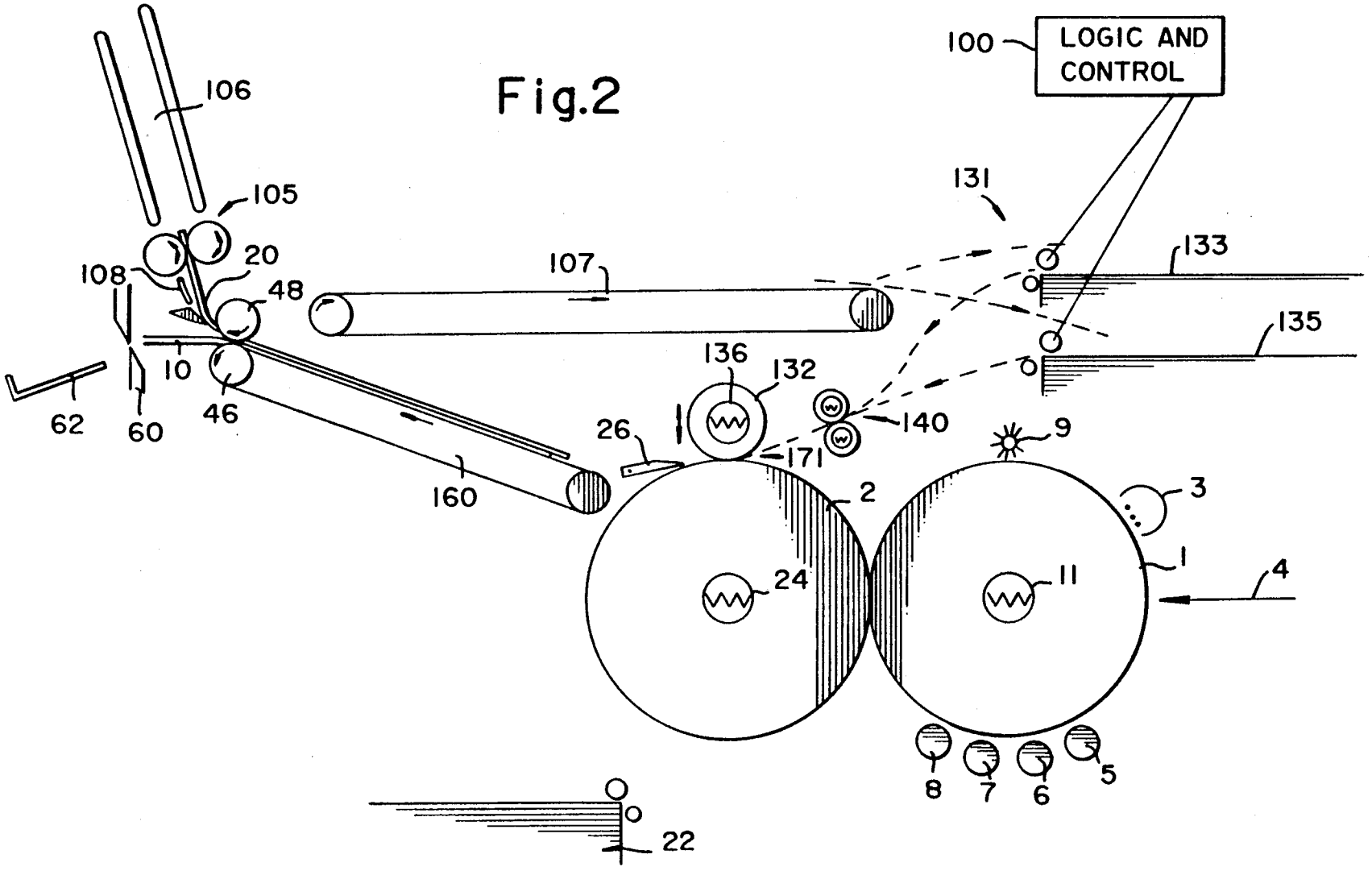
FIG. 2 is a side schematic of an alternative form of an image forming apparatus constructed according to the invention.

FIG. 2 shows an alternative image forming apparatus in which the toner images are formed on image member 1 in the same way as in FIG. 1 and transferred to a receiving sheet held to a transfer drum 2 also as in FIG. 1. However, instead of separate fixing rolls, a single fixing roller 132 is articulatable into and out of engagement with transfer drum 2. After receiving sheet 10 has received all of its images and is exiting the transfer nip between drums 1 and 2, a fusing sheet is fed from a fusing sheet supply 131 through a pair of heated rollers 140 and into a nip 171 to be formed by transfer drum 2 and fixing roller 132. Fixing roller 132 is articulated toward transfer drum 2 as fusing sheet 20 and receiving sheet 10 enter nip 171. To assist in separation of the fusing sheet and transfer sheet it is preferable that the fusing sheet slightly lead the transfer sheet into nip 171. Preferably, fixing roller 132 is moved into pressure applying engagement with the sandwich in nip 171 as the receiving sheet 10 enters the nip and slightly after fusing sheet 20 has entered the nip. Fixing roller 132 is internally heated by a lamp 136 to help maintain the fusing sheet and the receiving sheet at a temperature which maintains the toner image and any thermoplastic layer at or above its glass transition temperature.

A transport device 160 transports the sandwich to separation rollers 46 and 48 while the sandwich is being cooled, as in FIG. 1. The fusing sheet is separated from the receiving sheet and returned to fusing sheet supply 131. FIG. 2 shows a different geometric configuration for the image-forming apparatus in this respect. Fusing sheet 20, after separation from receiving sheet 10 is fed between a pair of reversible rollers 105 which drives the fusing sheet 20 into a turnaround area 106 until the trailing edge of fusing sheet 20 leaves separation roller 48. At this point, rollers 105 are reversed, reversing the direction of movement of the fusing sheet. A deflector 108 is moved to a position deflecting the now reversed fusing sheet onto a fusing sheet transport 107 which transports the fusing sheet back to fusing sheet supply 131. Fusing sheet supply 131 has sub-supplies 133 and 135 comparable to supplies 33 and 35 in FIG. 1 from which fusing sheets having different textures can be fed. FIG. 2 illustrates the control by a logic and control 100 of the sub-supplies 133 and 135 to allow operator, push-button control of the type of fusing sheet used and therefore the texture of the final image.

The FIG. 2 structure has many of the advantages of the FIG. 1 structure plus elimination of the necessity of a second fixing roller. However, the most remarkable advantage of the FIG. 2 structure is that heat loss due to the separation of the receiving sheet from transfer drum 2 prior to fixing is totally eliminated. Note also that there is virtually no independent handling of the receiving sheet between the transfer of images and the fixing of the images thereby further reducing the likelihood of disturbance of those images. If transfer from image member 1 to receiving sheet 10 is made at high pressure, care must be taken not to allow the movement of transfer roller 132 to disturb the exposure with laser 4. For example, exposure can be delayed until roller 132 is articulated away from drum 2.

Figure 6:
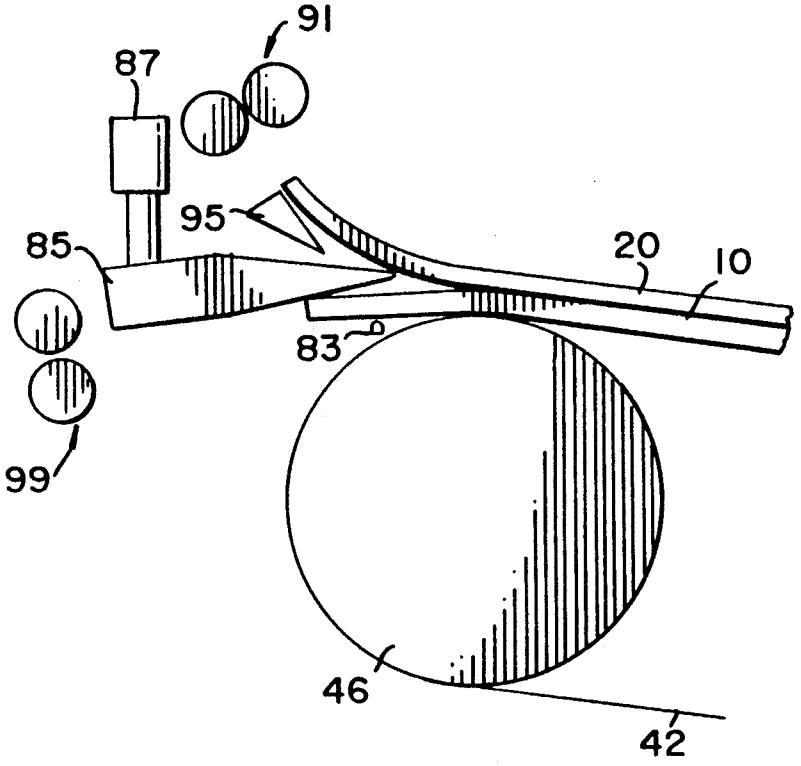

Separation of the fusing sheet from the receiving sheet at separation rollers 46 and 48 can be performed in a number of ways. FIGS. 3–6 illustrate different approaches to separating these sheets. As mentioned above, the fusing sheet can be fed into nips 71 or 171 slightly ahead of the receiving sheet. The fusing sheet leading edge thus overlaps the leading edge of the receiving sheet slightly. FIGS. 3, 5 and 6 illustrate use of this aspect in separating the sheets. According to FIG. 3, separation roller 48 is positioned slightly downstream from separation roller 46. A vacuum source 81 is connected to ports in separation roller 48 in at least the portion of roller 48 that initially touches fusing sheet 20 as fusing sheet 20 and receiving sheet 10 leave transport device 42. A vacuum applied internally to separation roller 48 causes the fusing sheet to adhere to separation roller 48 and begin to travel around separation roller 48 as it moves in a clockwise direction. The toner image (and thermoplastic layer, if any) are below their glass transition temperatures. If the receiving sheet 10 is relatively thick, its beam strength will cause it to separate from fusing sheet 20 and be fed below a pawl or skive 85. Alternatively, receiving sheet 10 could be held to separation roller 46 (through belt 42) and the beam strength of fusing sheet 20 used to separate the sheets. This has the advantage of using the likely greater beam strength of fusing sheet 20, but the disadvantage of preferring overlapping the receiving sheet beyond the fusing sheet leading edge.

If the beam strength of receiving sheet 10 is not enough to separate the sheets, receiving sheet 10 follows receiving sheet 20 which is held to separation roller 48 by the vacuum source 81. An optical sensor 83 senses the arrival of the leading edge of the sandwich, that is, the leading edge of fusing sheet 20. It triggers actuation of a solenoid 87 which pivots separation skive 85 into contact with the portion of the fusing surface of fusing sheet 20 which extends beyond the leading edge of receiving sheet 10. The separation skive then separates the two sheets as they are driven forward by transport 42 with the fusing sheet following separation roller 48 and the transfer sheet going below separation skive 85 toward cutter 60 (FIG. 1).

Figure 4:
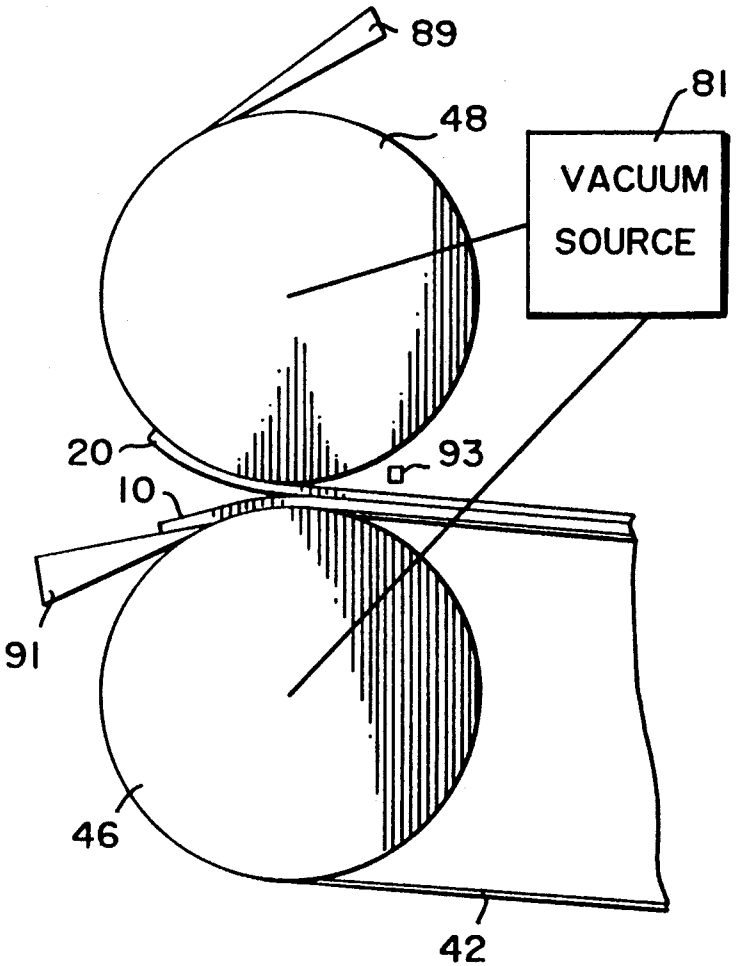
FIGS. 3-6 are side schematics of alternative embodiments of a separation device usable in either of the apparatus shown in FIGS. 1 and 2.
Figure 5:
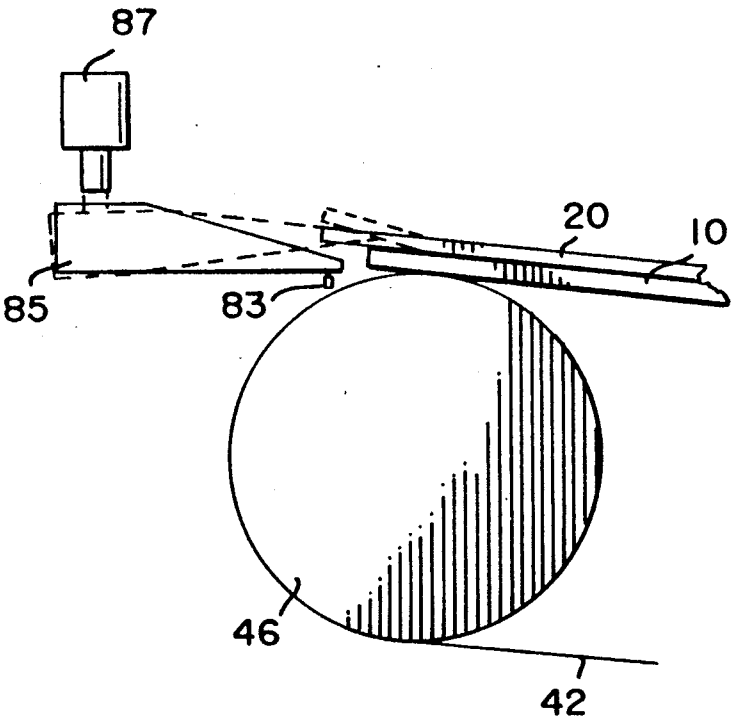

FIG. 4 illustrates an alternative device for separating the receiving sheet and the fusing sheet. According to FIG. 4 both separation rollers 46 and 48 are connected to the vacuum source 81. A vacuum applied to vacuum openings in separation roller 46 grips receiving sheet 10 through belt 42 while the vacuum applied through openings in separation roller 48 grips fusing sheet 20 thereby pulling the two sheets apart. Fusing sheet 20 is allowed to continue to follow separation roller 48 and is held by the vacuum until it is skived by a remote skive 89 for return to the fusing sheet supply. Receiving sheet 10 is skived from separation roller 46 by a skive 91 after it has progressed sufficiently that it will not return into contact with fusing sheet 20. To assure maintenance of such separation an additional guide, not shown, can be placed to fit between the sheets as they separate. A leading edge sensor 93 is positioned in advance of the separation rollers 46 and 48 and can be used (in both FIGS. 3 and 4) to control timing of the application of the vacuum to rollers 46 and 48. Note that in this embodiment the fusing sheet 20 has not been positioned to overlap the receiving sheet 10, since that aspect is not useful in providing separation as it is with the FIG. 3 structure.

FIGS. 5 and 6 illustrate a preferred separating embodiment particularly suitable with fusing sheets and receiving sheets of substantial beam strength. It is similar to the FIG. 3 embodiment except that vacuum separation roller 48 is eliminated and the beam strength or stiffness of the sheets is used to separate the sheets. According to FIG. 5, the sheets 10 and 20 separate from belt 42 as it moves around roller 46. Roller 46 can be as small as necessary to provide such separation. When the leading edge of fusing sheet 20 is sensed by sensor 83, solenoid 87 is triggered and pawl or skive 85 is rotated to raise the leaded portion of sheet 20 as shown in phantom in FIG. 5. The beam strength of the two sheets causes them to separate and they travel on opposite sides of pawl 85, as shown in FIG. 6. Receiving sheet 10 moves to roller 99 and on for further treating, cutting, or the like, while fusing sheet 20 moves rollers 91 (or 105) to begin its return to the fusing sheet supply.

Both the FIGS. 1 and 2 apparatus have the advantages already mentioned of providing pressure application at full machine speed with cooling at a slower speed. These advantages improve machine configuration, provide thermal savings and compactness of machine design. Cooling can be done with the sandwich stopped which makes different cooling schemes available than schemes associated with a moving belt or web. These configurations eliminate the endless belt fusing web which was preferred in the prior art. The fusing sheets can be replaced easily when damaged or when a different type of sheet is desired. The problems of belt tracking and belt seams do not have to be dealt with.

Note that the receiver goes through only one heating and cooling cycle, the single heating cycle spans both transfer and fixing and the cooling cycle occurs only after fixing. The fusing sheets themselves are considerably less expensive than an endless belt with its seams and critical tolerances.

Although FIGS. 1 and 2 show a single fusing sheet-transfer sheet sandwich carried by transport device 40, more than one sandwich could be fed onto a transport device at a time. For example, copy sandwiches could be stacked by feeding more sandwiches onto the top of preceding sandwiches, with the sandwiches being removed from the bottom as they cool.

Fusing sheets can be of a variety of constructions. A number of materials for such sheets are suggested with respect to the belt designs described in the aforementioned Rimai et al (appl. 07/405,258) and Aslam et al references. Those references are incorporated by reference herein for all of their disclosure, but especially with respect to materials usable for the fusing sheets with this invention.

The invention has been described particularly with respect to receiving sheets that have a heat-softenable thermoplastic outer layer in which toner is embedded. It is particularly well suited for application to such receiving sheets. However, it can be used with other receiving sheets not having this feature, for example ordinary or specially treated paper or transparency stock.

The invention has its greatest advantage when used in combination with a heat transfer system because the invention saves much of the heat used in transfer and applies it to the fixing process.

The invention is useful with single color images, but will have its best application in multicolor images because of its special applicability to reducing the relief image created in superposing a series of single color dry toner images.

The invention has been described in detail with particular reference to a preferred embodiment thereof, but it will be understood that variations and modifications can be effected within the spirit and scope of the invention as described hereinabove and as defined in the appended claims.

We claim:

1. An image forming apparatus of the type in which a dry toner image is created on a receiving sheet and the toner image is fixed to the receiving sheet by the application of heat and pressure, said image forming apparatus comprising:

a supply of at least one fusing sheet, said fusing sheet having a finite length and a fusing surface, means for feeding a fusing sheet from said fusing sheet supply into contact with a receiving sheet having a toner image with the fusing surface in contact with the toner image, means for heating the toner image to at least its glass transition temperature, means for applying a force to the receiving sheet and fusing sheet urging the fusing surface against the toner image to provide sufficient pressure to fix the heated toner image to the receiving sheet, means for transporting the receiving sheet and fusing sheet away from the heat applying means to allow said toner image to cool while still in contact with said fusing surface, means for separating said fusing sheet and receiving sheet after said toner image has cooled sufficiently to permit such separation without offset of toner onto said fusing surface, and means for feeding said fusing sheet back to said fusing sheet supply.

2. An image forming apparatus according to claim 1 wherein said fusing surface is hard and smooth and provides a glossy surface treatment to said toner image.

3. An image forming apparatus according to claim 2 wherein said fusing surface is a metallic ferrotyping surface.

4. An image forming apparatus according to claim 1 wherein said fusing sheet is slightly longer in the in-track direction than the receiving sheet and said fusing sheet is positioned in contact with the receiving sheet to slightly overlap the leading end of the receiving sheet.

5. The image forming apparatus according to claim 4 wherein said means for separation is a pawl which is positioned to engage the portion of the fusing sheet which overlaps the leading edge of the receiving sheet to skive the receiving sheet away from the fusing sheet.

6. Image forming apparatus according to claim 1 wherein said means for separating said fusing sheet and receiving sheet includes means for attracting one of said sheets away from a direction of movement of the other sheet by the transporting means.

7. The image forming apparatus according to claim 1 wherein said means for separating includes means for attracting said sheets in opposite directions and includes a pair of separation rollers having vacuum openings and means for applying a vacuum to said openings for attracting the outside surface of each of said sheets away from the other sheet.

8. An image forming apparatus according to claim 1 further including means for heating said fusing sheet prior to contact of the fusing sheet with the receiving sheet.

9. Image forming apparatus according to claim 1 wherein said means for applying force to the receiving sheet and fusing sheet includes a pair of rollers between which said fusing sheet and receiving sheet are fed, at least one of which rollers is heated.

10. An image forming apparatus according to claim 9 including means for bringing said fusing sheet into contact with at least one heated roller to heat said fusing sheet prior to its contact with said receiving sheet.

11. An image forming apparatus comprising:

means for forming a series of different color, single color, dry, unfixed toner images on an image member, means for bringing said series of toner images into transfer relation with a receiving sheet in the presence of sufficient heat to transfer said toner images in registration to a surface of said receiving sheet to create an unfixed multicolor toner image on said surface, means for overlaying a fusing sheet on the toner image, said fusing sheet having a finite length and a hard fusing surface which contacts said toner image, means for applying heat and pressure to the receiving sheet and fusing sheet to urge the fusing surface against the toner image to fix the toner image, means for feeding the receiving sheet and fusing sheet away from the pressure and heat applying means to allow said toner image to cool in contact with said fusing surface, and means for separating said fusing sheet and receiving sheet after said toner image has cooled sufficiently to allow such separation without offset of said toner image onto said fusing surface.

12. An image forming apparatus, comprising:

means for forming a series of single color, dry, unfixed toner images on an image member, a transfer drum, means for securing a receiving sheet to said transfer drum, said receiving sheet having a leading edge and a heat-softenable outer layer positioned away from said drum, means for heating said transfer drum to heat said heat-softenable layer to its softening point, means for rotating said transfer drum to bring the heat-softenable layer into contact with said toner images to transfer said toner images to said heat-softenable layer in registration to form a multicolor toner image at least partially embedded in said heat-softenable layer, means for superposing a fusing sheet in contact with said multicolor image on said heat-softenable layer, said fusing sheet having a finite length in the in-track direction and a leading edge that is positioned at or near the leading edge of the receiving sheet, means for applying heat and pressure to the receiving sheet and fusing sheet to urge the fusing sheet against the toner image to fix the toner image, means for transporting the receiving sheet and fusing sheet away from the means for applying heat and pressure to allow said toner image and thermoplastic layer to cool in contact with said receiving sheet, and means for separating said fusing sheet and receiving sheet after said toner image and thermoplastic layer have cooled sufficiently to allow separation without offset.

13. The apparatus according to claim 12 wherein said heat and pressure applying means includes a pair of rollers, at least one of which is heated and means for rotating said rollers to move the receiving sheet at substantially the same speed the receiving sheet is moved by rotation of the transfer drum.

14. The apparatus according to claim 13 wherein said means for transporting includes means for moving said receiving sheet and fusing sheet at a speed slower than they are moved by said pair of rollers.

15. The apparatus according to claim 12 wherein said means for transporting includes means for holding said receiving sheet and fusing sheet in a stopped condition prior to separation.

16. The apparatus according to claim 12 wherein said means for superposing includes means for overlapping the leading edge of the receiving sheet by the leading edge of the fusing sheet.

17. The apparatus according to claim 12 further including means for applying cooling air to said receiving sheet and fusing sheet before separation.

18. An image forming method comprising:

forming a series of different color toner images on an image member, transferring said toner images in registration to a receiving sheet, feeding a fusing sheet from a supply of fusing sheets having a finite length into overlying relation with said multicolor toner image on said receiving sheet, supplying sufficient heat and pressure to said fusing sheet and receiving sheet to fix the multicolor toner image to said receiving sheet, allowing said toner image to cool while still in contact with said fusing sheet, and separating said fusing sheet and receiving sheet after said toner image is sufficiently cool that it does not offset onto said fusing sheet when separated.

19. The method according to claim 18 wherein said pressure applying step is accomplished while moving the fusing sheet and the receiving sheet at a first speed and said cooling step is accomplished while moving the fusing sheet and receiving sheet at a second speed slower than said first speed.

20. The method according to claim 18 wherein said transfer step is accomplished at a first speed and said pressure applying step is accomplished also at said first speed while said cooling step is accomplished with said receiving sheet and fusing sheet moving at a speed slower than said first speed.

21. The method according to claim 18 wherein said receiving sheet has a heat-softenable layer and said transfer step includes heating said layer to its softening point and at least partially embedding said toner images in said layer, and said fixing step includes supplying sufficient heat and pressure to said fusing and receiving sheets to further embed said toner images in said layer.

* * * * *